US010047958B2

(12) United States Patent
Erbas-Sen et al.

(10) Patent No.: US 10,047,958 B2
(45) Date of Patent: Aug. 14, 2018

(54) COMBUSTOR WALL WITH TAPERED COOLING CAVITY

(71) Applicant: United Technologies Corporation, Farmington, CT (US)

(72) Inventors: Nurhak Erbas-Sen, Manchester, CT (US); Frank J. Cunha, Avon, CT (US)

(73) Assignee: United Technologies Corporation, Farmington, CT (US)

( * ) Notice: Subject to any disclaimer, the term of this patent is extended or adjusted under 35 U.S.C. 154(b) by 130 days.

(21) Appl. No.: 15/026,761

(22) PCT Filed: Oct. 6, 2014

(86) PCT No.: PCT/US2014/059269

§ 371 (c)(1),
(2) Date: Apr. 1, 2016

(87) PCT Pub. No.: WO2015/054115

PCT Pub. Date: Apr. 16, 2015

(65) Prior Publication Data

US 2016/0252249 A1 Sep. 1, 2016

Related U.S. Application Data

(60) Provisional application No. 61/887,695, filed on Oct. 7, 2013.

(51) Int. Cl.

| | |
|---|---|
| ***F23R 3/06*** | (2006.01) |
| ***F23R 3/00*** | (2006.01) |
| ***F23R 3/08*** | (2006.01) |

(52) U.S. Cl.
CPC ..... *F23R 3/002* (2013.01); *F23R 3/06* (2013.01); *F23R 3/08* (2013.01); *F23R 2900/03041* (2013.01); *F23R 2900/03042* (2013.01); *F23R 2900/03044* (2013.01)

(58) Field of Classification Search
CPC ..... F23R 2900/03044; F23R 3/06; F23R 2900/03041; F23R 2900/03042; F23R 3/002; F23R 2900/03043; F23R 2900/03045; F23R 3/007; F05B 2260/201
See application file for complete search history.

(56) References Cited

U.S. PATENT DOCUMENTS

| | | | |
|---|---|---|---|
| 4,109,459 | A | 8/1978 | Ekstedt et al. |
| 4,446,693 | A | 5/1984 | Pidcock et al. |
| 4,628,694 | A | 12/1986 | Kelm et al. |

(Continued)

FOREIGN PATENT DOCUMENTS

WO WO9849496 * 11/1998 ..... F23R 3/00

OTHER PUBLICATIONS

Extended European Search Report dated Sep. 15, 2016.

*Primary Examiner* — Arun Goyal
(74) *Attorney, Agent, or Firm* — O'Shea Getz P.C.

(57) ABSTRACT

A combustor wall is provided for a turbine engine and includes a combustor shell and a heat shield. The heat shield is attached to the shell with first and second cavities extending between the shell and the heat shield. The first cavity fluidly couples apertures defined in the shell with the second cavity. The second cavity fluidly couples the first cavity with apertures defined in the heat shield. The shell and the heat shield converge toward one another about the second cavity.

22 Claims, 7 Drawing Sheets

(56) References Cited

U.S. PATENT DOCUMENTS

| | | | | |
|---|---|---|---|---|
| 4,688,310 | A * | 8/1987 | Kelm | B21D 35/00 29/889.22 |
| 5,396,759 | A | 3/1995 | Richardson | |
| 7,093,439 | B2 | 8/2006 | Pacheco-Tougas et al. | |
| 7,104,067 | B2 * | 9/2006 | Bunker | F23M 5/00 60/752 |
| 7,146,815 | B2 | 12/2006 | Burd | |
| 7,373,778 | B2 * | 5/2008 | Bunker | F01D 25/12 431/351 |
| 7,934,382 | B2 | 5/2011 | Burd | |
| 7,954,325 | B2 | 6/2011 | Burd et al. | |
| 8,015,829 | B2 | 9/2011 | Coughlan, III et al. | |
| 8,443,610 | B2 | 5/2013 | Hoke et al. | |
| 8,826,668 | B2 * | 9/2014 | Lee | F01D 5/186 165/908 |
| 9,243,801 | B2 * | 1/2016 | Cunha | F23R 3/002 |
| 2005/0022531 | A1 | 2/2005 | Burd | |
| 2005/0150632 | A1 * | 7/2005 | Mayer | F01D 25/08 165/47 |
| 2006/0207259 | A1 | 9/2006 | Holt et al. | |
| 2009/0145132 | A1 * | 6/2009 | Johnson | F23R 3/002 60/755 |
| 2009/0255267 | A1 * | 10/2009 | Chen | F01D 9/023 60/756 |
| 2010/0095678 | A1 | 4/2010 | Hawie et al. | |
| 2011/0011095 | A1 | 1/2011 | Ladd et al. | |

* cited by examiner

COMBUSTOR WALL WITH TAPERED COOLING CAVITY

CROSS-REFERENCE TO RELATED APPLICATIONS

This application claims priority to PCT patent application No. PCT/US14/59269 filed Oct. 6, 2014, which claims priority to U.S. Provisional Patent Appln. No. 61/887,695 filed Oct. 7, 2013, which are hereby incorporated herein by reference in their entireties.

BACKGROUND OF THE INVENTION

1. Technical Field

This disclosure relates generally to a turbine engine and, more particularly, to a combustor for a turbine engine.

2. Background Information

A floating wall combustor for a turbine engine typically includes a bulkhead that extends radially between inner and outer combustor walls. Each of the combustor walls includes a shell and a heat shield which together define cooling cavities radially therebetween. These cooling cavities fluidly couple impingement apertures in the shell with effusion apertures in the heat shield.

During turbine engine operation, the impingement apertures direct cooling air from a plenum adjacent the combustor into the cooling cavities to impingement cool the heat shield. The effusion apertures direct the cooling air from the cooling cavities into a combustion chamber to film cool the heat shield. This cooling air subsequently mixes with a fuel-air mixture within the combustion chamber, thereby leaning out the fuel-air mixture in both an upstream fuel-rich primary zone and a downstream fuel-lean secondary zone. The primary zone of the combustion chamber is located between the bulkhead and the secondary zone, which is generally axially aligned with quench apertures in the combustor walls.

In an effort to increase turbine engine efficiency and power, temperature within the combustion chamber may be increased. However, increasing the temperature in the primary zone with a relatively lean fuel-air mixture may also increase NOx, CO and unburned hydrocarbon (UHC) emissions.

There is a need in the art for an improved turbine engine combustor.

SUMMARY OF THE DISCLOSURE

According to an aspect of the invention, a combustor wall is provided for a turbine engine. The combustor wall includes a shell and a heat shield. The heat shield is attached to the shell with first and second cavities extending between the shell and the heat shield. The first cavity fluidly couples apertures defined in the shell with the second cavity. The second cavity fluidly couples the first cavity with apertures defined in the heat shield. The shell and the heat shield converge toward one another about the second cavity.

According to another aspect of the invention, a combustor is provided for a turbine engine. The combustor includes a combustor wall, which includes a shell and a heat shield. The heat shield is attached to the shell with a first cavity and a second cavity therebetween. The first cavity is fluidly coupled between apertures in the shell and the second cavity.

The second cavity is fluidly coupled between the first cavity and apertures in the heat shield. A height of the second cavity decreases as the combustor wall extends away from the first cavity.

According to another aspect of the invention, another combustor is provided for a turbine engine. The combustor includes a combustor wall, which includes a shell and a heat shield with a first cavity and a second cavity between the shell and the heat shield. The shell and the heat shield converge towards one another as the second cavity extends away from the first cavity. The first cavity is fluidly coupled between apertures in the shell and the second cavity. The second cavity is fluidly coupled between the first cavity and apertures in the heat shield.

The shell may define a concavity configured to decrease a radial distance between the shell and the heat shield axially beyond the first cavity.

A height of the second cavity may decrease as the combustor wall extends away from the first cavity.

The shell and the heat shield may converge towards one another as the second cavity extends away from the first cavity.

The first cavity may have a substantially constant height.

The combustor wall may include a rail. This rail may be between the first cavity and the second cavity. The rail may extend between the heat shield and the shell. The rail may define one or more apertures that couple the first cavity with the second cavity.

The combustor wall (e.g., the shell and the heat shield) may be adapted to receive air in the first cavity. The combustor wall (e.g., the shell and the heat shield) may also be adapted to direct substantially all of the air from the first cavity into the second cavity.

The second cavity may extend away from the first cavity to a distal end defined by a rail. The apertures in the heat shield may be defined at (e.g., on, adjacent or proximate) the distal end.

The combustor wall (e.g., the shell and the heat shield) may be adapted to receive air in the first cavity. The combustor wall (e.g., the shell and the heat shield) may also be adapted to direct substantially all of the air from the first cavity into the second cavity and through the apertures defined in the heat shield.

The second cavity may extend between a proximal end defined by a rail and the distal end. The shell may include second apertures that are coupled with the second cavity and defined at (e.g., on, adjacent or proximate) the proximal end.

The combustor may include a second combustor wall and a combustor bulkhead. The combustor bulkhead may extend between the combustor wall and the second combustor wall. The combustor wall, the second combustor wall and the combustor bulkhead may form a combustion chamber. The first cavity may be arranged between the second cavity and the combustor bulkhead.

The combustor wall may include one or more cooling features arranged within the first cavity. The combustor wall may also or alternatively include one or more cooling features arranged with the second cavity.

The foregoing features and the operation of the invention will become more apparent in light of the following description and the accompanying drawings.

DETAILED DESCRIPTION OF THE INVENTION

Figure 1:
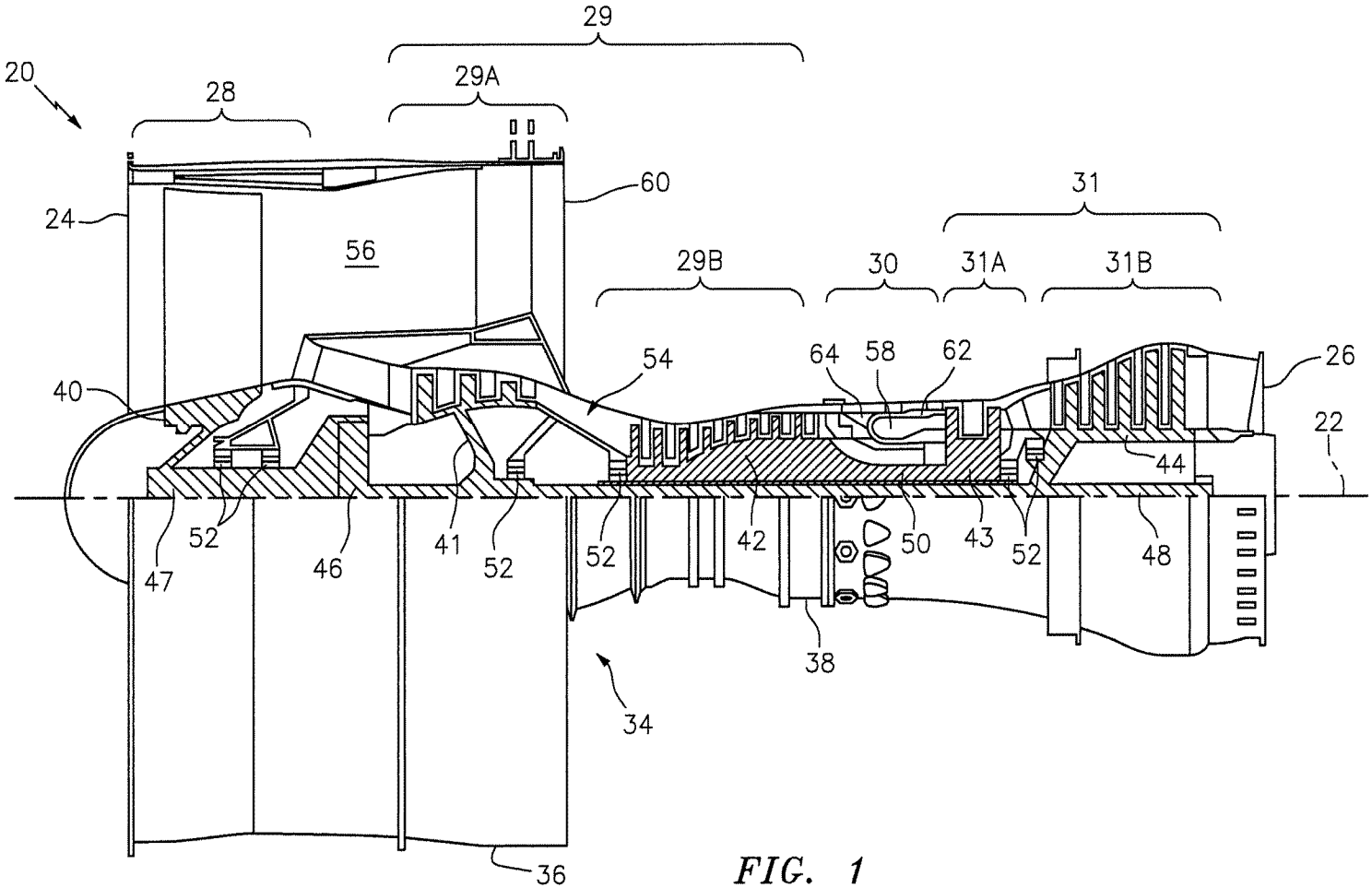
FIG. 1 is a side cutaway illustration of a geared turbine engine.

FIG. 1 is a side cutaway illustration of a geared turbine engine 20. This engine 20 extends along an axis 22 between an upstream airflow inlet 24 and a downstream airflow exhaust 26. The engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise attached to) one or more respective rotor disks. The fan rotor 40 is connected to a gear train 46 (e.g., an epicyclic gear train) through a shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stator such as, for example, an annular support strut.

Air enters the engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the engine 20 through the airflow exhaust 26. Within the combustor section 30, fuel is injected into an annular combustion chamber 58 and mixed with the core air. This fuel-core air mixture is ignited to power the engine 20 and provide forward engine thrust. The bypass air is directed through the bypass gas path 56 and out of the engine 20 through a bypass nozzle 60 to provide additional forward engine thrust. Alternatively, the bypass air may be directed out of the engine 20 through a thrust reverser to provide reverse engine thrust.

Figure 2:
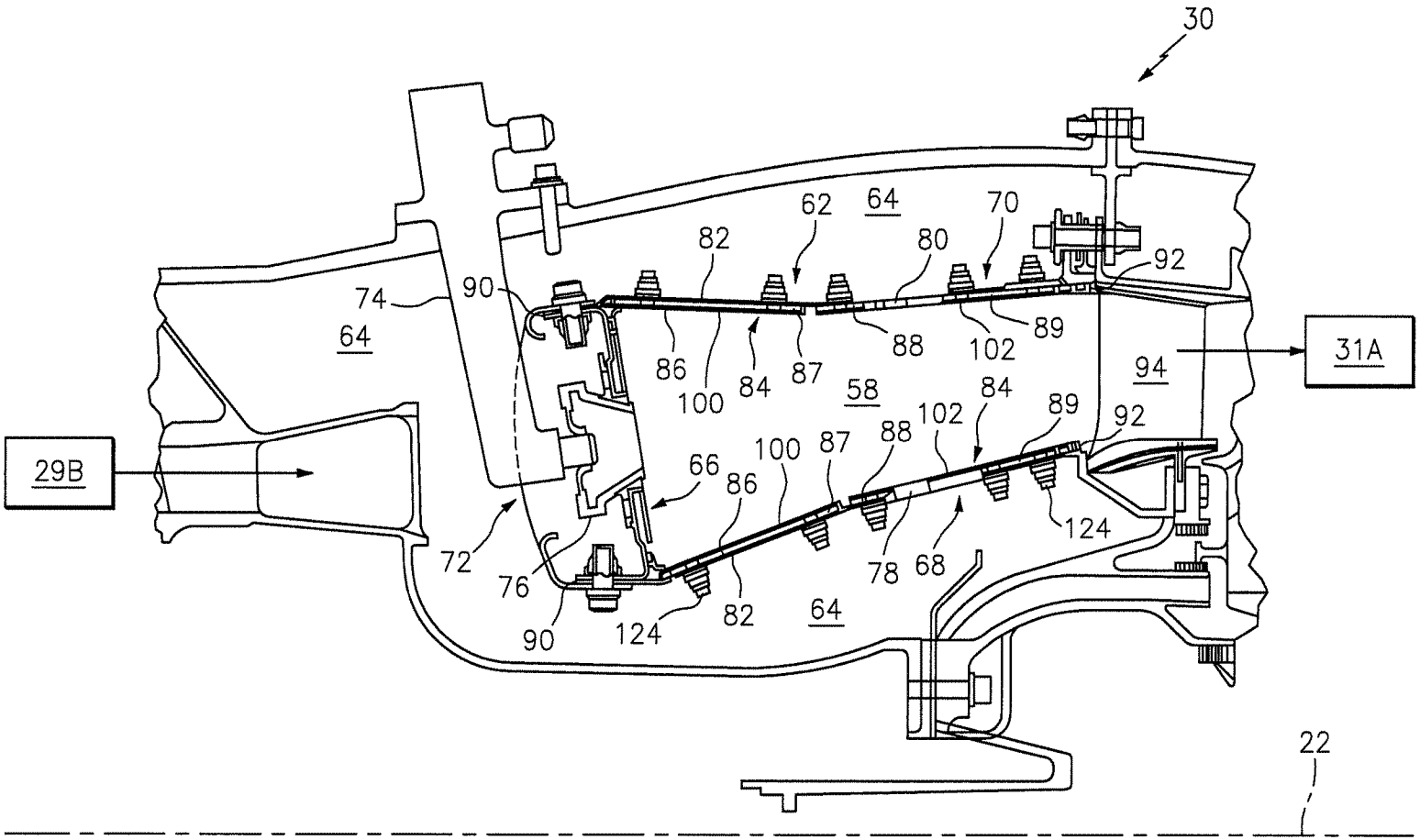
FIG. 2 is a side sectional illustration of a portion of a combustor section.
Figure 3:
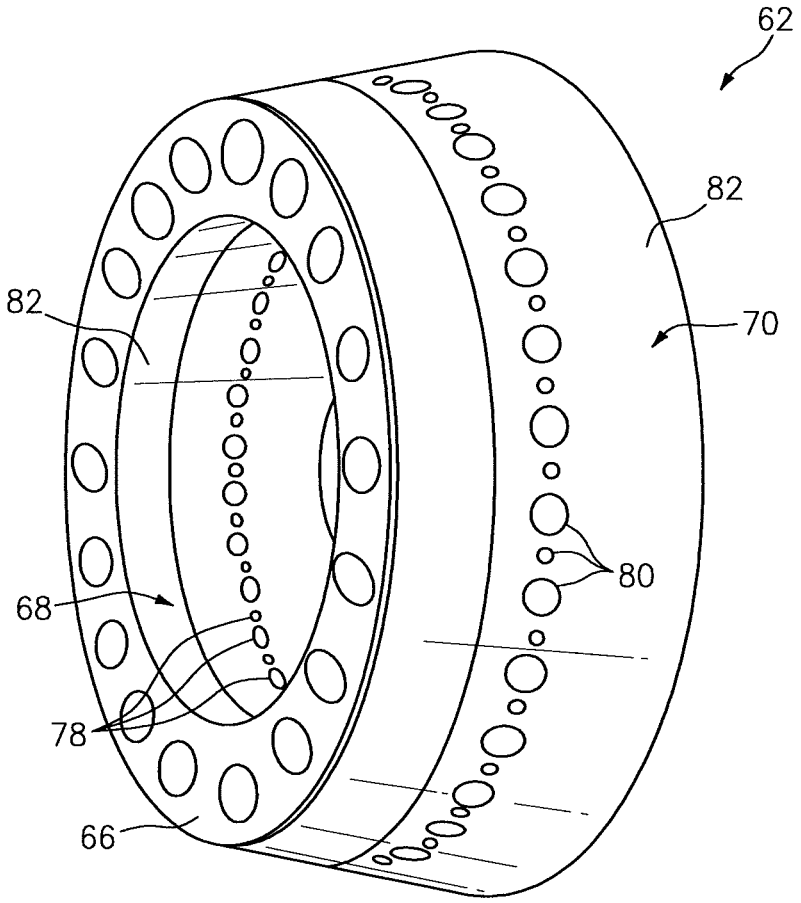
FIG. 3 is a perspective illustration of a portion of a combustor.

Referring to FIGS. 2 and 3, the combustor section 30 includes a floating wall combustor 62 arranged within an annular plenum 64. This plenum 64 receives compressed core air from the compressor section 29B, and provides the core air to the combustor 62 as described below in further detail.

The combustor 62 includes an annular combustor bulkhead 66, a tubular combustor radially inner wall 68 relative to axis 22, a tubular combustor radially outer wall 70 relative to axis 22, and a plurality of fuel injector assemblies 72. The bulkhead 66 extends radially between and is connected to the inner wall 68 and the outer wall 70. The inner wall 68 and the outer wall 70 each extends axially along the axis 22 from the bulkhead 66 towards the turbine section 31A, thereby defining the combustion chamber 58. The fuel injector assemblies 72 are disposed circumferentially around the axis 22, and mated with the bulkhead 66. Each of the fuel injector assemblies 72 includes a fuel injector 74 mated with a swirler 76. The fuel injector 74 injects the fuel into the combustion chamber 58. The swirler 76 directs some of the core air from the plenum 64 into the combustion chamber 58 in a manner that facilitates mixing the core air with the injected fuel. Quench apertures 78 and 80 in the inner and/or the outer walls 68 and 70 direct additional core air into the combustion chamber 58 for combustion.

Referring to FIG. 2, the inner wall 68 and/or the outer wall 70 each have a multi-walled structure; e.g., a hollow dual-walled structure. The inner wall 68 and the outer wall 70 of FIG. 2, for example, each includes a tubular combustor shell 82, a tubular combustor heat shield 84, and one or more cooling cavities 86-89 (e.g., impingement cavities).

Figure 4:
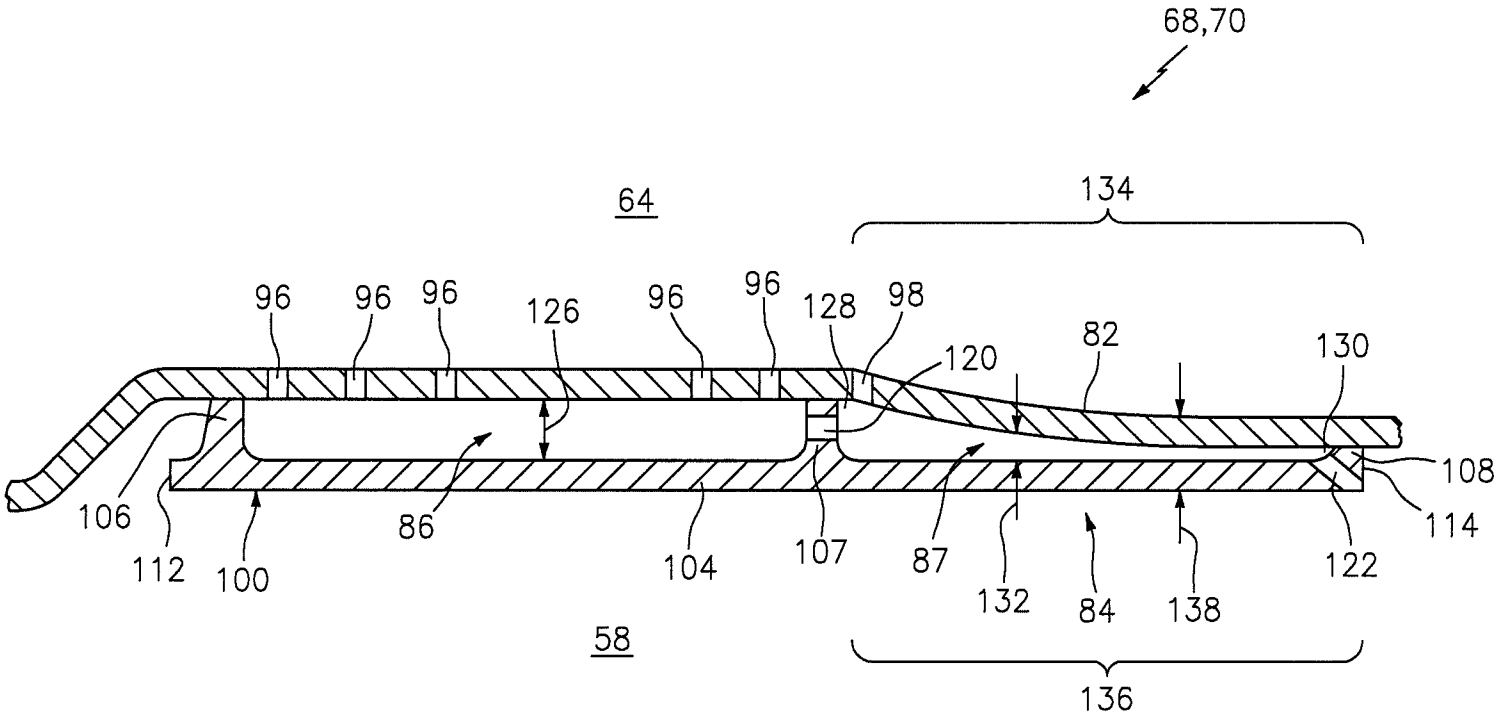
FIG. 4 is a side sectional illustration of a portion of a combustor wall.

The shell 82 extends axially along the axis 22 between an upstream end 90 and a downstream end 92. The shell 82 is connected to the bulkhead 66 at the upstream end 90. The shell 82 may be connected to a stator vane assembly 94 or the HPT section 31A at the downstream end 92. Referring to FIG. 4, the shell 82 includes one or more cooling apertures 96 and 98. One or more of these cooling apertures 96 and 98 may be configured as impingement apertures. The cooling apertures 96, for example, direct core air from the plenum 64 into the cooling cavities 86 to impinge against and cool the heat shield 84. The cooling apertures 98 direct core air from the plenum 64 into cooling cavities 87 to impinge against and cool the heat shield 84.

Referring to FIG. 2, the heat shield 84 extends axially along the axis 22 between an upstream end and a downstream end. The heat shield 84 includes a plurality of heat shield panels 100 and 102. The panels 100 are arranged upstream of the panels 102 and the quench apertures 78 and 80, which extend radially through one or more of the panels 102. The panels 100 are arranged around the axis 22 forming an upstream hoop, which may be generally aligned with a fuel-rich primary zone of the combustion chamber 58. The panels 102 are also arranged around the axis 22 forming a downstream hoop, which may be generally aligned with a fuel-lean secondary zone of the combustion chamber 58.

Figure 5:
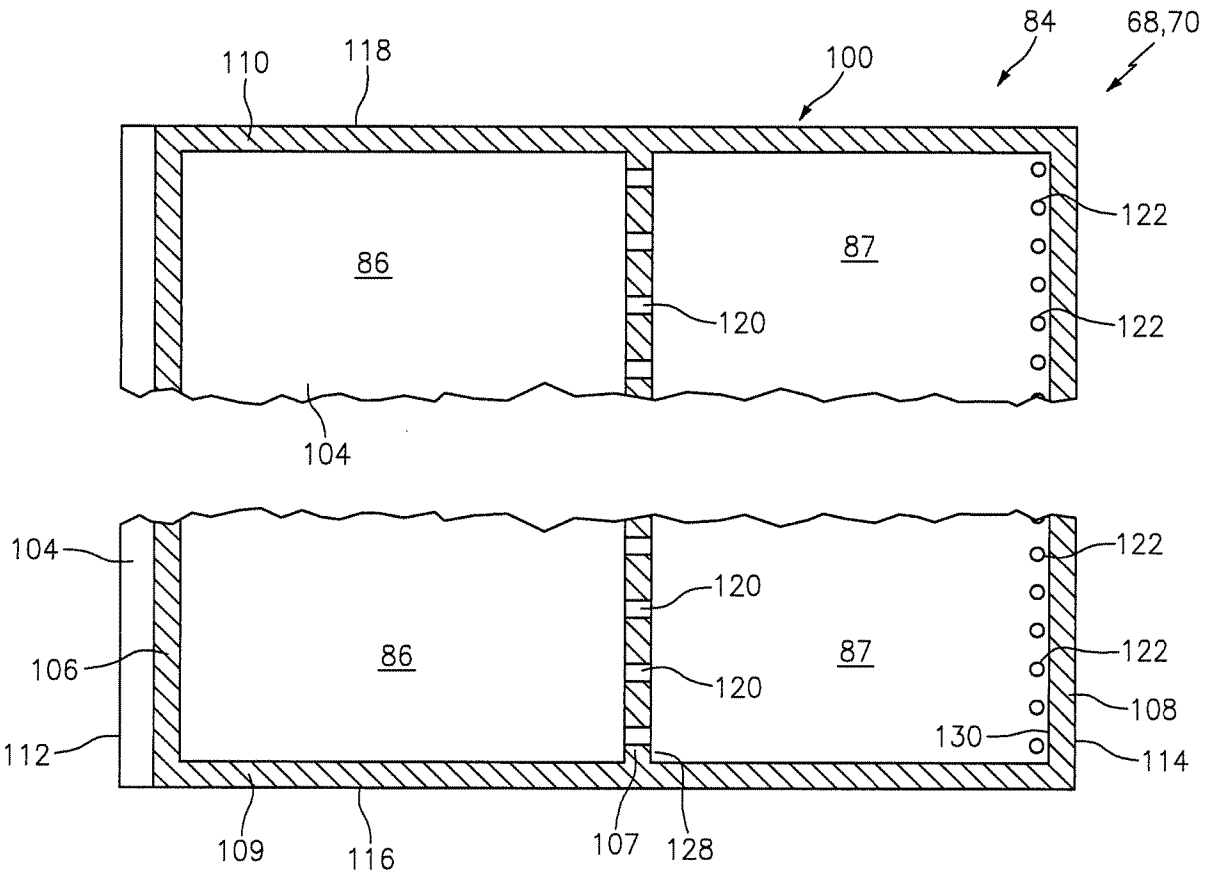
FIG. 5 is a circumferential sectional illustration of a portion of the combustor wall and, more particularly, end portions of a heat shield panel.

Referring to FIGS. 4 and 5, each of the panels 100 includes a panel base 104 and a plurality of rails 106-110. The panel base 104 may be configured as a generally curved (e.g., arcuate) plate. The panel base 104 extends axially between an upstream axial end 112 and a downstream axial end 114. Each panel base 104 of each panel 100 extends circumferentially between opposing circumferential ends 116 and 118 (FIG. 5).

Each of the rails 106-110 of the outer wall 70 extend radially out from the panel base 104. Each of the rails 106-110 of the inner wall 68 extend radially in from the panel base 104. The rail 109 is arranged at (e.g., on, adjacent or proximate) the circumferential end 116. The rail 110 is arranged at the circumferential end 118. Each of the rails 106-108 extends circumferentially between and is connected to the rails 109 and 110. The rail 106 is arranged at the upstream end 112. The rail 107 is arranged axially (e.g., approximately midway) between the rails 106 and 108. The rail 107 includes one or more apertures 120, which are arranged circumferentially around the axis. The rail 108 is arranged at the downstream end 114.

Each of the panels 100 also includes a plurality of cooling apertures 122. These cooling apertures 122 are arranged axially between the rail 107 and the rail 108, for example, at the downstream end 114; e.g., on a corner between the panel base 104 and the rail 108. One or more of the cooling apertures 122 may be configured as effusion apertures. The cooling apertures 122, for example, direct core air which has entered the respective cooling cavity 87 into the combustion chamber 58 to film cool the heat shield 84; e.g., to film cool the panels 102 (see FIG. 2) of the heat shield 84.

Referring to FIG. 2, the heat shield 84 of the inner wall 68 circumscribes the shell 82 of the inner wall 68, and defines a radially inner side (relative to axis 22) facing the combustion chamber 58. The heat shield 84 of the outer wall 70 is arranged radially within the shell 82 of the outer wall 70, and defines a radially outer side (relative to axis 22) facing the combustion chamber 58 opposite the radially inner side.

The heat shield 84 and, more particularly, each of the panels 100 and 102 are respectively attached to the shell 82 by a plurality of mechanical attachments 124 (e.g., threaded studs). The respective shell 82 and heat shield 84 of each wall 68, 70 thereby form the respective cooling cavities 86-89 in each wall 68, 70.

The cooling cavities 86 are arranged circumferentially around the axis 22. Referring to FIG. 4, each of the cooling cavities 86 is fluidly coupled between one or more of the cooling apertures 96 and the apertures 120 of a respective one of the panels 100.

Referring to FIG. 5, each cooling cavity 86 extends circumferentially between the rails 109 and 110 of a respective one of the panels 100. Each cooling cavity 86 extends axially between the rails 106 and 107 of a respective one of the panels 100.

Referring to FIG. 4, each cooling cavity 86 extends radially between the shell 82 and the panel base 104 of a respective one of the panels 100, thereby defining a height 126 (e.g., a radial height) of the cooling cavity 86. In the embodiment of FIG. 4, the height 126 remains substantially constant as the respective cooling cavity 86 extends through the respective wall 68, 70. In alternative embodiments, however, the height 126 may change as the respective cooling cavity 86 extends through the respective wall 68, 70.

The panels 100 are configured such that the cooling cavities 87 are arranged circumferentially around the axis. Each of the cooling cavities 87 is fluidly coupled between and with the apertures 120 and the cooling apertures 122 of a respective one of the panels 100. Each of the cooling cavities 87 therefore is fluidly coupled with an adjacent one of the cooling cavities 86. Each of the cooling cavities 87 may also be fluidly coupled between one or more of the cooling apertures 98 and the cooling apertures 122 of a respective one of the panels 100.

Referring to FIG. 5, each cooling cavity 87 extends circumferentially between the rails 109 and 110 of a respective one of the panels 100. Each cooling cavity 87 extends axially between a proximal (e.g., upstream) end 128 and a distal (e.g., downstream) end 130. The proximal end 128 is defined by a side of the rail 107 and, thus, proximate the cooling cavity 86 and adjacent the respective cooling apertures 98. The distal end 130 is defined by a side of the rail 108 and, thus, proximate the downstream end 114 and adjacent the cooling apertures 122.

Referring to FIG. 4, each cooling cavity 87 extends radially between the shell 82 and the panel base 104 of a respective one of the panels 100, thereby defining a height 132 (e.g., a radial height) of the respective cooling cavity 87. This height 132 decreases as the cooling cavity 87 extends axially (e.g., in a downstream direction) from the proximal end 128 to the distal end 130. The height 132 at the proximal end 128, for example, may be substantially equal to the height 126. The height 132 at the distal end 130, in contrast, is less than the height 126; e.g., between about one half (½) and about one sixteenth (1/16) of the height 126. Each cooling cavity 87 therefore radially tapers as the respective wall 68, 70 extends (e.g., downstream) away from the respective cooling cavity 86.

The cooling cavity 87 tapered geometry is defined by an axial portion 134 of the shell 82 and an axial portion 136 of the heat shield 84. These portions 134 and 136 of the shell 82 and the heat shield 84 radially converge towards one another as the respective wall 68, 70 and the cooling cavities 87 extend axially away from the cooling cavities 86. The shell portion 134, for example, has a curvilinear (e.g., an elliptical, parabolic or logarithmic) sectional geometry (e.g., a concavity) that extends radially towards the heat shield portion 136, which has a substantially flat sectional geometry. In this manner, a radial thickness 138 of the respective wall 68, 70 may also decrease as the wall 68, 70 and the cooling cavities 87 extend axially away from the cooling cavities 86 and the rails 107.

Figure 6:
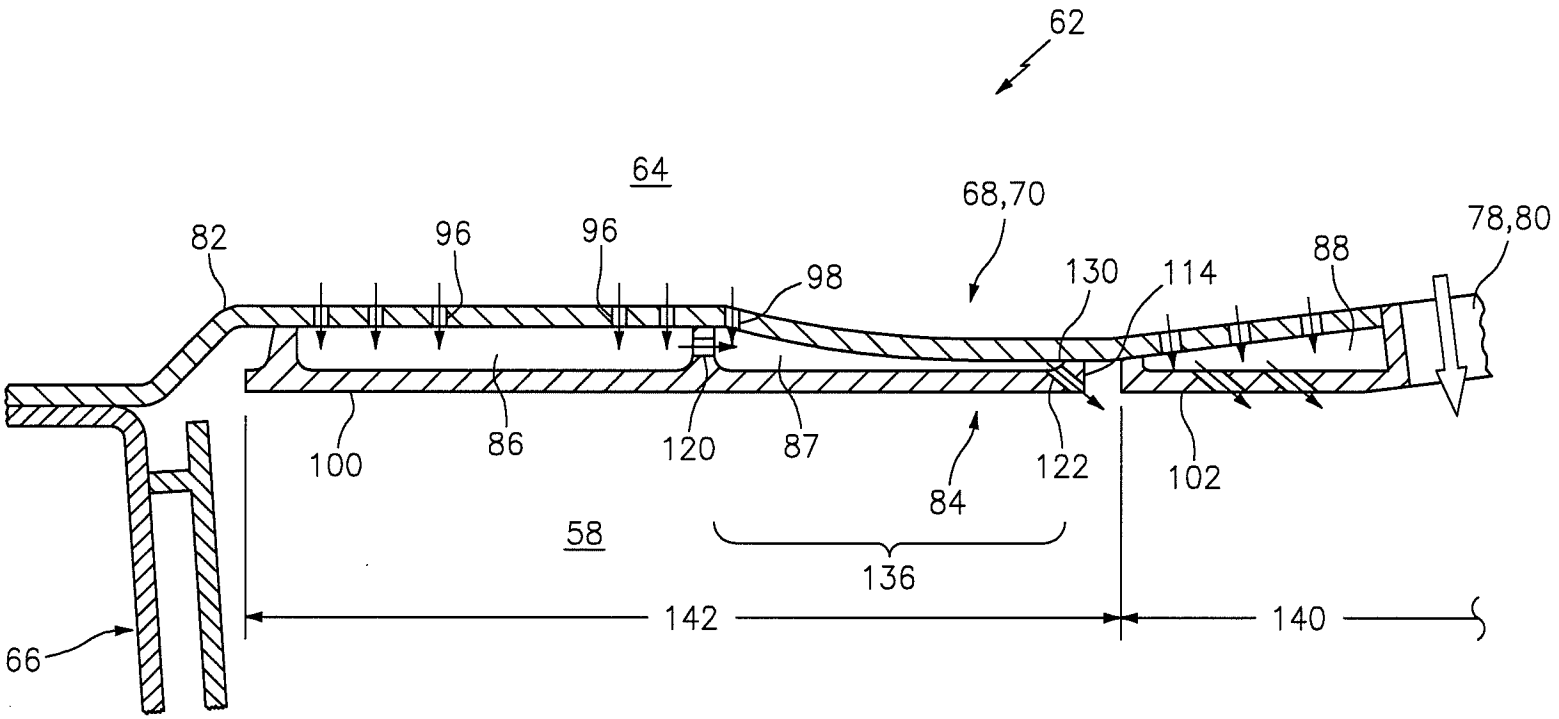
FIG. 6 is a side sectional illustration of a portion of the combustor.

Referring to FIG. 6, a first portion of the core air from the plenum 64 is directed into each cooling cavity 86 through the respective cooling apertures 96 during turbine engine operation. A second portion of the core air from the plenum 64 may be directed into each cooling cavity 87 through the respective cooling apertures 98. The first and the second portions of the core air impinge against and cool the heat shield 84. Substantially the entire first portion of the core air is subsequently directed into an adjacent one of the cooling cavities 87 through the respective apertures 120. The first and the second portions of the core air are accelerated through the cooling cavity 87 towards its distal end 130 by the tapered geometry, thereby increasing convective cooling of the heat shield portion 136. Substantially the entire first and second portions of the core air are subsequently directed through the respective cooling apertures 122 to film cool a downstream portion of the heat shield 84; e.g., the panels 102.

The cooling apertures 122 direct substantially all of the core air used for cooling the panels 100 into a downstream portion 140 (e.g., the secondary zone) of the combustion chamber 58, which also receives the core air from the quench apertures 78 and 80. The fuel-core air mixture within the combustion chamber 58 therefore may remain relatively stoichiometrically rich within an upstream portion 142 (e.g., the primary zone) of the combustion chamber 58, which axially extends from the bulkhead 66 approximately to the downstream end 114. As a result, the temperature within the upstream portion 142 of the combustion chamber 58 may be increased to increase engine efficiency and power without, for example, substantially increasing NOx, CO and unburned hydrocarbon (UHC) emissions of the engine 20.

In some embodiments, the shell 82 may be configured without the cooling apertures 98. In such a configuration, the respective wall 68, 70 may be configured such that each cooling cavity 87 may, for example, only receive core air from the respective cooling cavity 86.

Figure 7:
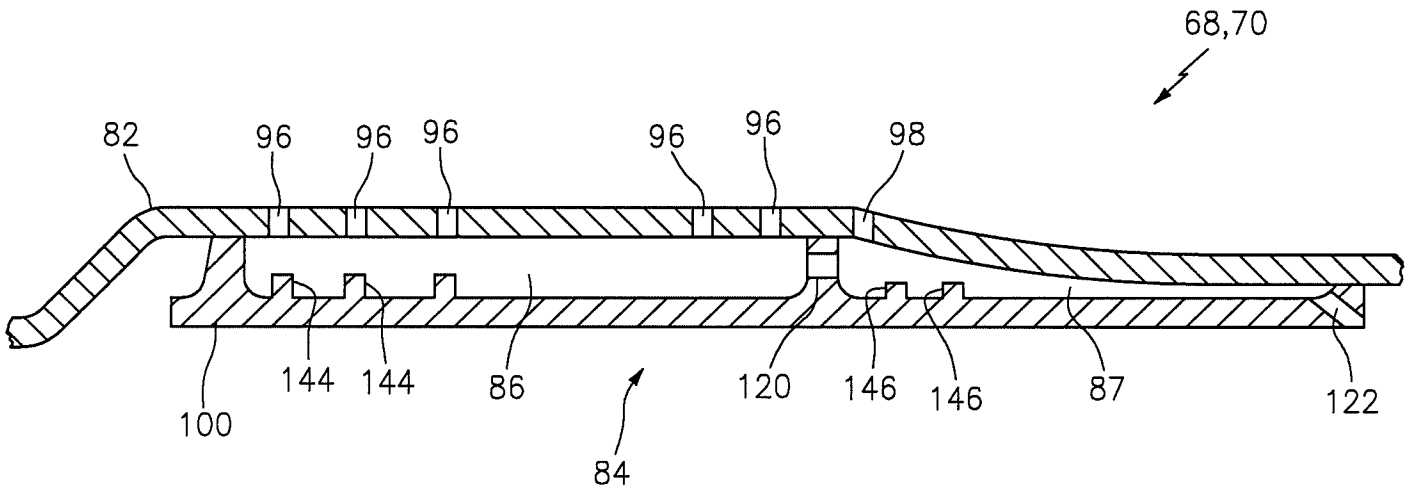
FIG. 7 is a side sectional illustration of a portion of an alternate embodiment combustor wall.

Referring to FIG. 7, in some embodiments, one or more of the walls 68, 70 may each include one or more cooling features 144 and 146. Each of the cooling features 144 and 146 of FIG. 7 is configured as a cooling pin, which may draw thermal energy from the panel base 104 and transfer the energy into the core air within the cavities via convection. However, one or more of the cooling features 144 and/or 146 may alternatively be configured as a pedestal, a dimple, a chevron shaped protrusion, a diamond shaped protrusion, an axially and/or circumferentially extending trip strip, or any other type of protrusion or device that aids in the cooling of the panel 100. Referring again to FIG. 7, one or more of the cooling features 144 extend into a respective one of the cooling cavities 86 from the heat shield 84. One or more of the cooling features 146 extend into a respective one of the cooling cavities 87 from the heat shield 84. One or more of the cooling features 144 and 146, of course, may also or alternatively extend into the respective cooling cavities 86 and 87 from the shell 82.

The shell 82 and/or the heat shield 84 may each have a configuration other than that described above. In some embodiments, for example, the shell portion 134 may have a substantially flat sectional geometry, and the heat shield portion 136 may have a curvilinear sectional geometry that extends radially towards the shell portion 134. In some embodiments, both the shell portion 134 and the heat shield portion 136 may have curvilinear sectional geometries that extend radially toward one another. In some embodiments, the shell portion 134 and/or the heat shield portion 136 may have non-curvilinear sectional geometries that extend radially toward one another. In some embodiments, one or more of the cooling cavities 87 may be arrange upstream of one or more of the cooling cavities 86. In some embodiments, each panel 100 may define one or more additional cooling cavities with the shell 82. One or more of these cooling cavities may be upstream of the cooling cavity 86, between the cooling cavities 86 and 87, and/or downstream of the cooling cavity 87. The present invention therefore is not limited to any particular combustor wall 68, 70 configurations.

The terms "upstream", "downstream", "inner" and "outer" are used to orientate the components of the combustor 62 described above relative to the turbine engine 20 and its axis 22. A person of skill in the art will recognize, however, one or more of these components may be utilized in other orientations than those described above. The present invention therefore is not limited to any particular combustor spatial orientations.

The combustor 62 may be included in various turbine engines other than the one described above. The combustor 62, for example, may be included in a geared turbine engine where a gear train connects one or more shafts to one or more rotors in a fan section, a compressor section and/or any other engine section. Alternatively, the combustor 62 may be included in a turbine engine configured without a gear train. The combustor 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A combustor wall for a turbine engine, the combustor wall comprising:

a combustor shell; and a combustor heat shield attached to the combustor shell with first and second cavities extending between the shell and the heat shield, wherein an entirety of the heat shield is discrete from the combustor shell;

wherein the first cavity is enclosed by a first rail, the combustor shell, the heat shield and a second rail;

wherein the second cavity is enclosed by the second rail, the combustor shell, the heat shield and a third rail;

wherein the first cavity fluidly couples apertures defined in the combustor shell with the second cavity;

wherein the second cavity fluidly couples the first cavity with apertures defined in the heat shield to hot combustion gases through apertures defined in the second rail;

wherein the combustor shell and the heat shield converge toward one another about the second cavity;

wherein the second cavity extends axially between a proximal end and a distal end; and wherein a height of the second cavity decreases as the second cavity extends axially in a downstream direction from the proximal end to the distal end.

2. The combustor wall of claim 1, wherein the combustor shell defines a concavity configured to decrease a radial distance between the combustor shell and the heat shield axially beyond the first cavity.

3. The combustor wall of claim 1, wherein the height of the second cavity decreases as the combustor wall extends away from the first cavity; and the first cavity has a substantially constant height.

4. The combustor wall of claim 1, wherein the combustor wall is adapted to receive air in the first cavity, and direct substantially all of the air from the first cavity into the second cavity.

5. The combustor wall of claim 1, wherein the second cavity extends away from the first cavity to the distal end which is defined by the third rail; and the apertures defined in the heat shield are placed at the distal end.

6. The combustor wall of claim 5, wherein the proximal end is defined by the second rail.

7. The combustor wall of claim 1, wherein the combustor shell and the heat shield are adapted to receive air in the first cavity; and direct substantially all of the air from the first cavity into the second cavity and through the apertures defined in the heat shield.

8. The combustor wall of claim 1, wherein the combustor wall further includes one or more cooling features arranged within the first cavity.

9. The combustor wall of claim 1, wherein the combustor wall further includes one or more cooling features arranged with the second cavity.

10. The combustor wall of claim 1, wherein the combustor shell and the heat shield are configured such that substantially all air entering the first cavity through the apertures defined in the shell is directed into the second cavity.

11. A combustor for a turbine engine, the combustor comprising:

the combustor wall of claim 1;

a second combustor wall; and a combustor bulkhead extending between the combustor wall and the second combustor wall, wherein the combustor wall, the second combustor wall and the combustor bulkhead form an annular combustion chamber.

12. The combustor wall of claim 1, wherein the combustor shell and the heat shield converge toward one another such that the second cavity comprises a tapered geometry defined by an axial portion of the shell and an axial portion of the heat shield;

the axial portion of the shell has a curvilinear sectional geometry, and the axial portion of the heat shield has a flat sectional geometry.

13. The combustor wall of claim 1, wherein the height of the second cavity at the distal end is less than one half of the height of the second cavity at the proximal end.

14. A combustor for a turbine engine, the combustor comprising:

a combustor wail including a shed and a heat shield attached to the shell with a first cavity and a second cavity therebetween;

a second combustor wall; and a combustor bulkhead extending between the combustor wall and the second combustor wall;

the first cavity enclosed by a first rail, the shell, the heat shield and a second rail;

the second cavity enclosed by the second rail, the shell, the heat shield and a third rail;

the first cavity fluidly coupled between apertures in the shell and the second cavity; and the second cavity fluidly coupled between the first cavity and apertures in the heat shield through apertures in the second rail;

wherein the shell and the heat shield converge toward one another such that a height of the second cavity decreases as the combustor wail extends away from the first cavity;

wherein second cavity comprises a tapered geometry defined by an axial portion of the shell arid an axial portion of the heat shield, and the axial portion of the shell has a curvilinear sectional geometry that extends radially towards the axial portion of the heat shield; and wherein the combustor wall, the second combustor wall and the combustor bulkhead form an annular combustion chamber.

15. The combustor of claim 14, wherein the shell and the heat shield converge towards one another as the second cavity extends away from the first cavity.

16. The combustor of claim 14, wherein the first cavity has a substantially constant height.

17. The combustor of claim 14, wherein the combustor wall is adapted to receive air in the first cavity; and direct substantially all of the air from the first cavity into the second cavity and through the apertures in the heat shield.

18. The combustor of claim 14, wherein the first cavity is arranged between the second cavity and the combustor bulkhead.

19. The combustor of claim 14, wherein the shell and the heat shield are configured such that substantially all air entering the first cavity through the apertures in the shell is directed into the second cavity.

20. A combustor for a turbine engine, the combustor comprising:

a combustor wail including a shell and a heat shield with a first cavity and a second cavity between the shell and the heat shield;

a second combustor wall; and a combustor bulkhead extending between the combustor wall and the second combustor wall;

the first cavity enclosed by a first rail, the shell, the heat shield and a second rail;

the second cavity enclosed by the second rail, the shell, the heat shield and a third rail;

the first cavity fluidly coupled between apertures in the shell and the second cavity; and the second cavity fluidly coupled between the first cavity and apertures in the heat shield through apertures in the second rail;

wherein the shell and the heat shield converge towards one another as the second cavity extends away from the first cavity;

wherein the second cavity is defined by an axial portion of the shell and an axial portion of the heat shield, the axial portion of the shell has a sectional geometry that extends radially towards the axial portion of the heat shield, and the sectional geometry is an elliptical sectional geometry, a parabolic sectional geometry or a logarithmic sectional geometry; and wherein the combustor wall, the second combustor wall and the combustor bulkhead form an annular combustion chamber.

21. The combustor of claim 20, wherein a height of the second cavity decreases as the combustor wall extends away from the first cavity.

22. The combustor of claim 20, wherein the shell defines a concavity configured to decrease a radial distance between the shell and the heat shield axially beyond the first cavity.

* * * * *